United States Patent [19]

Smith

[11] Patent Number: 4,621,458

[45] Date of Patent: Nov. 11, 1986

[54] FLAT DISK POLISHING APPARATUS

[76] Inventor: Robert S. Smith, 1263 Emory St., San Jose, Calif. 95126

[21] Appl. No.: 785,489

[22] Filed: Oct. 8, 1985

[51] Int. Cl.[4] ..... B24B 7/00

[52] U.S. Cl. ..... 51/111 R; 51/118

[58] Field of Search ..... 51/111 R, 117, 118

[56] References Cited

U.S. PATENT DOCUMENTS

| | | | |
|---|---|---|---|
| 1,556,995 | 10/1925 | Johnson | 51/118 |
| 1,831,958 | 11/1931 | Indge et al. | 51/118 |
| 3,089,292 | 5/1963 | Hunt | 51/118 |
| 3,859,756 | 1/1975 | Zerbola | 51/118 |

*Primary Examiner*—James G. Smith

*Assistant Examiner*—Joseph T. Zatarga

*Attorney, Agent, or Firm*—Robert Samuel Smith

[57] ABSTRACT

An apparatus for polishing a surface such as the surface of a disk which avoids rounding of the edge of the surface and reduces wear of the polishing medium. The apparatus includes a buffer plate whose boundary conforms to and is adjacent to the edge of the surface being polished but the buffer plate is displaced in a direction perpendicular to the plate by a small increment so that droop of the polishing medium over the edge of the surface being polished is reduced. Means of establishing the incremental displacement is disclosed in terms of the required polishing pressure and breakdown pressure of the polishing medium.

3 Claims, 7 Drawing Figures

FLAT DISK POLISHING APPARATUS

FIELD OF THE INVENTION

This invention relates to an apparatus for polishing a substrate such as for a memory disk or semiconductor wafer so as to obtain a very flat surface.

DESCRIPTION OF THE PRIOR ART

There are a number of products in the current marketplace, particularly in electronics, that require disks that are not only very smooth, but are also very flat. Two important examples are memory disks used in magnetic recording and Silicon wafers used to manufacture integrated circuit "chips".

Generally speaking, the method of manufacturing these disks (substrates) involves two steps. The first is a machining step to provide a disk that has the desired peripheral dimensions, (and inside diameter in the case of the memory disk), and a thickness that is a little greater than the desired finished thickness, then a second step involving a series of polishing operations in order to obtain a flatness and smoothness that exceed values prescribed in accordance with requirements of the product. The latter polishing step which removes a layer of typically less than 500 microinches, also provides the final desired thickness. The requirements for flatness and finish become more stringent with each succeeding generation of the product at the marketplace.

There are two types of polishing machines that are used in the polishing step.

In one type of machine, the disk is supported so that it is free to rotate about its center while flat circular polishing pads rotating independently press with flat polishing surface against the flat area of the disk. The pads rotate thereby causing the disks to rotate so that the entire flat area of both sides of the disk are polished. Polishing pads with successively finer abrasive are applied successively to provide the final finish.

In a second type of polishing apparatus the polishing medium is two concentric rotating wheels and the polishing sufaces are two flat sides of the wheels facing one another. The two polishing surfaces are pressed toward one another so that a number of disks, positioned around the periphery of the wheels are sandwiched between the flat polishing surfaces of the wheels so that both sides of all of the disks are polished as the wheels rotate. Each disk protudes only partially between the wheels so that rotation of each disk results from rotation of the wheels. The position of the disks is maintained by rollers on fixed pins which contact the outer edge of the disks.

With both types of polishing machines, the polishing surface extends over the edge of the disk surface to be polished. This results in very large presssure on the area of the disk close to its edge compared to the pressure distal to the edge and causes two very undesirable results. The first is that the surface of the disk close to the edge (typically extending inward by a distance of half an inch) becomes rounded by the polishing action. The second problem resulting from excessive edge pressure is that the polishing pad wears excessively and loses flatness thereby necessitating more frequent replacement of the polishing media. Since current requirements of flatness are typically a bow of less than two or three microinches over a distance of an inch across the disk surface, the problem imposed by excessive pressure at the edge is an important one.

The increased pressure at the edge of the disk increases as the pad is made more flexible and softer. But the pad must be made more soft and/or flexible in order to obtain desired surface finish. Therefore with polishing machines of the prior art, a compromise must be made in selecting pad softness and flexibility and imposing pad pressure.

SUMMARY

It is an objective of this invention to provide a polishing apparatus which polishes a surface which is flat out to the edge of the surface.

It is a further objective of this invention to provide a polishing apparatus which provides a polished surface that has a very fine finish.

It is yet another objective of this invention to provide a polishing apparatus that provides greatly reduced wear on the polishing media so that the life of the polishing media is greatly extended.

The essential inventive concept is an apparatus with a polishing medium having a polishing surface for polishing an area of an object and a buffer plate whose boundary conforms to the edge of the area and is slightly displaced normal to the surface of the buffer plate by a small increment so that the polishing surface pressed against the area and extending over the edge, is prevented from "drooping" appreciably at the edge because it is supported against the buffer plate. For optimum performance, the surface of the buffer plate is harder than the area being polished. This reduces wear not only of the buffer plate but also wear of the polishing medium. For example, if the plate to be polished is an aluminum substrate to provide a memory disk, the buffer plate may be "hard anodized" aluminum whose thickness is 0.001 inches thinner than the first plate. Under these circumstances, the buffer plate can be used in the polishing of many areas before it would finally be worn to the point where it must be replaced. Minimal wear on the buffer plate results not only because it is hard but because, the pressure on the buffer plate is much less than the pressure on the area being polsished.

One configuration of polishing machine that includes the inventive concept is similar to the type one configuration discussed in the prior art. In addition, however, a second flat plate, the buffer plate, with hardened buffer surfaces and thickness slightly less than the disk to be polished, has a boundary which is a hole whose diameter is slightly greater than the disk being polished. The disk being polished is supported on rollers and positioned within the hole so that the polishing surface contacts both the flat area of the disk and the buffer surface. The polishing medium is two flat circular pads that are rotated and thereby cause the disk to rotate so that the entire flat area of the disk is polished by contact with the polishing surface. Excessive droop of the polishing surface is prevented by support from the buffer surface.

A second configuration of polishing machine of the instant invention is similar to type two discussed in the prior art wherein the polishing medium is two concentric wheels with a polishing surface on the flat side of each wheel facing the other wheel and a plurality of disks being polished are. In this instance, the buffer plate is a number of plate sectors where each sector is positioned between each disk and its neighboring disk so that as the polishing surface of the wheel passes in contact with each surface of the disk, it is prevented from excessive drooping at the edges of the disks by support from the buffer sector.

DISCUSSION OF THE DRAWINGS AND PREFERRED EMBODIMENTS

Figure 1:
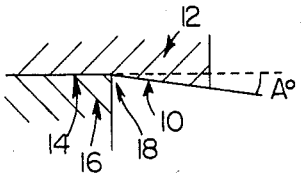
In FIG. 1 is shown a sectional view of a polishing medium in contact with an object to be polished as practiced in the prior art where the polishing medium extends over the edge of the area illustrating the droop of the medium.

Turning now to a more detailed description, FIG. 1 is presented to illustrate the prior art and shows in cross section a polishing surface, 10 of the polishing medium 12 in contact with an area 14 to be polished of an object 16 having an edge 18. The droop of the polishing surface extending over the edge 18 is illustrated by the droop angle, A.

Figure 2:
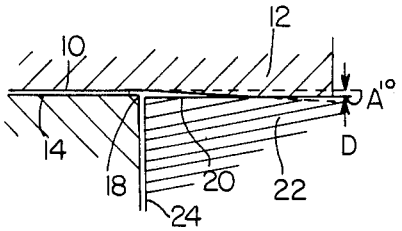
In FIG. 2 is shown the imposition of a buffer plate to minimize droop of the polishing medium over the edge of the surface being polished.

The invention is illustrated in FIG. 2 where there is shown a cross sectional view of the polishing medium, 12, with polishing surface, 10, in contact with area, 14, extending over edge, 18, where it is supported by contact with buffer surface, 20, of buffer plate, 22. The boundary, 24, of the buffer surface, 20, is adjacent to the edge, 18, however the buffer surface, 20, is misplaced in a direction normal to the buffer surface, 20, by a small increment, d, so that support of the polishing surface, 12, on the buffer surface, 20, reduces the droop angle to a new value, A'.

The ability of the buffer plate to reduce dramatically the wear of the polishing medium and rounding of the edge may be explained in terms of a lengthy mathematical analysis of the edge pressure exerted by two contacting surfaces as discussed in the publication, "Handbook of Analytical Design for Wear," edited by C. W. MacGregor, published by the Plenum Press, New York, 1964, Library of Congress Catalog Card Number, 64-8816. The reference is hereby incorporated into this specification. The analysis shows that the pressure at an edge of a surface contacting a second surface can be many times the average pressure at a position distal from the edge.

Figure 3:
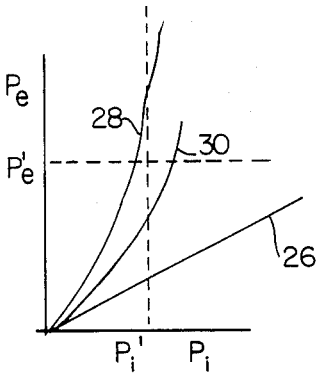
In FIG. 3 is shown a plot of pressure of the polishing surface at the edge of the area being polished versus average pressure over the entire area being polished.

In accordance with this invention, the method of selecting the increment, d, is illustrated qualitatively by the diagram of FIG. 3. The abscissa, Pi, is the pressure on the area (i.e., force/unit area) by the polishing medium, 12 (FIG. 2) at an appreciable distance from the edge of the disk. Pi is uniform over the entire area of contact except near the edge. Pe is the greatest pressure at any position on the disk and this high pressure point occurs at the edge and may be as great as 100 times Pi in the absence of a buffer surface of this invention. For a given Pi, Pe determines the rate of wear of the polishing medium and the rounding of the edge. Pi' is the value of Pi that must be imposed in order to achieve significant polishing action over the entire area being polished. The bottom curve, 26, shows that when a buffer plate is installed whose thickness equals the thickness of the disk, Pe is a linear function of Pi whereas in the absence of a buffer plate as shown in the top curve, 28, Pe increases exponentially as Pi increases. The intermediate curve, 30, illustrates the Pe-Pi relation when a buffer plate is positioned and displaced a small increment as described above. Pe' is the value of pressure above which breakdown of the pad and rounding of the disk edge occurs. The diagram illustrates the fact that when the buffer plate of this invention is installed, a value of increment, d, may be selected so that the required value, Pi' may be imposed while the value of Pe is simultaneously maintained well below Pe'. This condition determines the upper limit of the value of increment, d.

The lower limit of the value of increment, d, is determined by the amount of material that must be removed by the polishing action.

A mathematical analysis developed from the theory of bending of plates such as presented in "Vibration and Sound" by P. M. Morse, McGraw Hill, N.Y., 1936, confirms the observation made in the reduction to practice of the instant inventive concept that the pressure on the buffer plate will be much smaller than Pe and Pi so that the buffer plate will not wear as quickly as the area being polished thus permitting use of the buffer plate to polish many areas before it wears too thin. The life of the buffer plate is also prolonged by selecting a buffer plate with a relatively hard surface.

Figure 4:
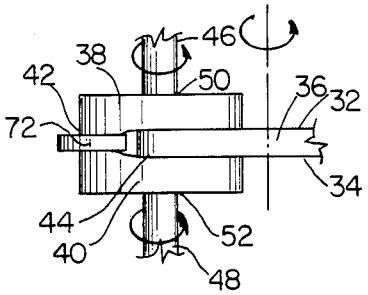
In FIG. 4 is shown one configuration of the invention used to polish disks.

FIG. 4 illustrates an embodiment of the invention in which the object having an area to be polished is the flat sides, 32 and 34, of a disk, 36. The polishing medium is two flat circular pads, 38 and 40 each having a flat polishing suface, 42 and 44 respectively, positioned against sides, 32 and 34, of the disk. Rotating shafts, 46 and 48, are attached at the centers, 50 and 52 respectively, perpendicularly to the sides of the pads opposite the polishing surfaces and means not shown are provided to move the shafts 46 and 48, axially so that the polishing surfaces are maintained in contact with the area of the disk to be polished.

Figure 5:
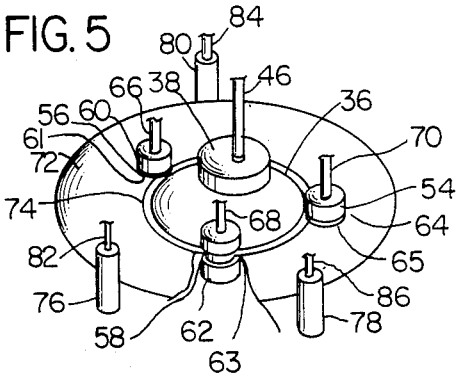
In FIG. 5 is shown, details of means to support the disk of the appartatus of FIG. 4.

FIG. 5 shows the disk support means in which the edge of the disk 36, is positioned in grooves, 54, 56 and 58, in the curved sides of supporting rollers, 60, 62 and 64. Each roller is slideably mounted on a fixed pin, 66,68 and 70 respectively, and is free to rotate and be positioned by pressure from the polishing pads. The buffer plate 72, partially cut away in the figur, is slightly thinner than the disk in accordance with the invention and has a hole 74 slightly larger than the diameter of the disk, 36, into which the disk, 36, is positioned. Sleeves, 76, 78 and 80, are perpendicularly attached to the edge of the buffer plate 72 and are slideabbly mounted on fixed pins, 82,84 and 86 respectively, so that the axial position of the disk and buffer plate is determined by the pads pressing on both sides of the disk 36 and buffer plate 72.

Figure 6:
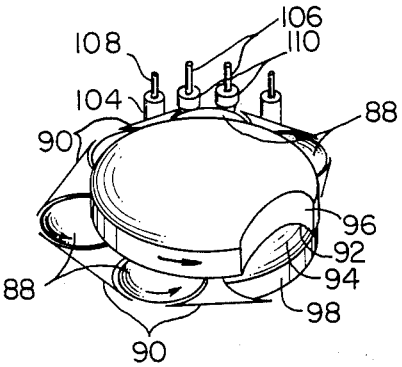
In FIG. 6 is shown a second configuratrion of the invention used to polish disks.

FIG. 6 illustrates an apparatus for polishing a plurality of disks 88 in which the disks are supported relative to the buffer plate 90 in accordance with the invention. The disks, 88, are polished simultaneously by moving contact with the flat polishing surfaces, 92 and 94, of rotating wheels, 96 (shown cut away) and 98, similar to the type two configuration discussed in the prior art.

Details of positioning the disks and buffer plates relative to the polishing pad are more clearly illustrated in FIG. 6 where details on only one disk, 88, and buffer sector, 90 are shown. Directions of rotation of disk and wheels are indicated by arrows. Each disk, 88, is urged to rotate by contact with the polishing wheels. Each disk is maintained in position by contact with positioning rollers, 110. Fixed pins, 106, support each roller, 110. The buffer sector, 90, is attached to sleeves, 104, which are slideably mounted on fixed pins, 108, so that the disk, 88, and buffer sector, 90, are positioned in a direction perpendicular to their surfaces by contact with the polishing surfaces, 92 and 94.

As the wheels, 96 and 98, rotate about their common axis they press on the sides of the disks, 88, thereby polishing the sides of the disks and causing the disks to rotate so that the entire area is contacted by the polishing surface of the wheels, 96 and 98. Simultaneously, the buffer sectors, 90, reduce the droop of the polishing surfaces over the edge of the disks and thereby reduce wear at the polishing surfaces and rounding of the edges of the disks.

The scope of means to mount the buffer plates is not limited to the configurations presented in the foregoing discussion which was presented for illustrative purposes.

Figure 7:
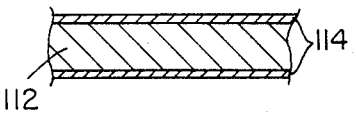
In FIG. 7 is shown a cross section of a buffer plate to illustrate its lamellar structure according to one embodiment.

Buffer plates may be fabricated from many types of materials such as ceramic or hardened steel. One example is "hard anodized" aluminum. The term "hard-anodized" is well known in the art to pertain to a special anodizing process involving anodically electrolyzing an aluminum surface in an aquaeous solution of sulfuric acid, about 15% by weight, at a solution temperature of typically 34° F. applying a current of 15 amperes per square foot for about an hour. This process would develop an oxide film of about 0.0005 inches on the surfaces of the buffer plate. The structure of the hard anodized buffer plate is illustrated by the cross sectional view of FIG. 7. Here is shown the interior of the buffer plate, 112, with anodized layers, 114, on each side.

In order to demonstrate the performance of this invention, a polishing apparatus was constructed in accordance with the first configuration described above. The thickness of the buffer plate was 0.001 inches less than thickness of the disks being polished. The buffer plate was hard anodized aluminum. A dozen disks were polished with the buffer plate in position and six were polished with the buffer plate removed. With the buffer plate in use, there was no detectable wear of the buffer plate as indicated by no loss of color of the black anodized surface nor was there any detecatable wear of the pad as indicated by the the aquaeous polishing coolant remaining clear. Furthermore, there was no rounding of the edges of the disks that could be detected by an optical flat laid on the disk surface at the edge. When six other disks were subjected to a similar polishing treatment with the buffer plate removed, wear of the pad was significant and the edge rounded by at least a light band per half inch when observed through an optical flat.

The description and drawings of the embodiments presented in the foregoing paragraphs are presented for purposes of illustration and may suggest other configurations and embodiments to those familiar with the art which are also included within the scope of this invention.

I claim:

1. An apparatus for polishing the first and second flat sides of a disk having a thickness, each side being bounded by an edge, which comprises:

a plurality of rollers free to rotate about their axes oriented perpendicular to said disk surfaces and whose curved side of each roller has a groove where contact is made to said edge of said disk so that said disk is supported but is free to rotate about its center a first pad and a second pad, each having a center and each having a first side covered with polishing medium and a second side;

a first shaft and a second shaft attached respectively perpendicularly to the second side at the center of said first and second pads so that each said pad may rotate about its center and slide in an axial direction so that said first side of each said first and second pads can be maintained in contact with said first and second side respectively of said disk thereby causing said disk to rotate in order to polish said entire first and second sides of said disk;

a flat buffer plate having a thickness that is slightly less than said thickness by a small increment of said disk and a boundary that is contoured so that said boundary may be positioned adjacent to said edge;

a plurality of sleeves perpendicularly attached to said buffer plate and each sleeve slides on a pin so that the location of said buffer plate is determined in the direction perpendicular to said buffer plate by contact with said polishing medium;

so that by selecting said small increment to be no larger than a value that limits droop of the polishing medium over the edges, the average pressure by the polishing medium over the surface of the disk is sufficient to polish the surface of the disk but the greatest pressure which occurs at the edge will not cause rounding of the disk edge or uneven wear of said polishing medium.

2. An apparatus for polishing flat surfaces of a plurality of disks having edges and each disk having closely the same thickness which comprises:

a plurality of rollers with curved surfaces contacting said edges of said disks and mounted perpendicular to said flat surfaces of said disks a first wheel concentric with a second wheel each having a flat side covered with polishing medium facing the other wheel;

a shaft perependicular to and supporting each wheel at its center so that said wheels can rotate and move away and toward each other and said side covered with polishing medium can contact said disk surfaces positioned between said converging surfaces thereby polishing said disk surfaces while rotating said disks;

a buffer plate having a thickness slightly less than said thickness of disks by a small increment and a boundary contoured to follow closely said edges of disks by having sectors wherein each said buffer sector extends into a region between a disk and its neighboring disk;

a plurality of supports attached to said buffer plate and each support may be slideably positioned on fixed supports so that sectors of said buffer plate are positioned perpendicularly by contact with said polishing medium;

so that said polishing medium on said flat sides of said rotating wheels contact both flat surfaces of each said disk causing said disks to rotate so that all of said flat surfaces are polished and wherein droop of said polishing media over said edges of said disks is minimized by supporting contact from said buffer plate so as to reduce uneven wear of said polishing medium and rounding of said edges of said disks.

3. An apparatus for polishing a first and a second side of a disk having a thickness and an edge bounding each side which comprises:

means for supporting said disk so that said disk is free to rotate about its axis unrestricted by said supporting means when subjected to a polishing action;

a first and second pad, each covered with a soft polishing medium supported by means for moving said first and second pad in contact with and tangent to said first and second disk surfaces respectively so that as said pads move, said disk surfaces are polished and said disks are urged to rotate thereby permitting the entire area of disk sides to be polished;

a buffer plate having a buffer thickness smaller than said disk thickness by a small increment and a boundary contoured to be close to said disk edge but is out of contact with said edge along an entire length of edge where said pads for polishing extend beyond said edge;

means for supporting said buffer plate which permits motion of said buffer plate in a direction perpendicular to said buffer plate thereby avoiding contact between said buffer plate and said disk and permitting adjustment of the position of said buffer plate by contact with said pads for polishing;

so that when said pads are polishing and rotating said disks, the droop of said polishing medium over the edge of said disk is restricted by contacting support from said buffer plate by an amount determined by said small increment which is selected to prevent excessive wear of said polishing medium and rounding of said disk edges.

* * * * *